US006719068B2

(12) United States Patent
Jönsson

(10) Patent No.: US 6,719,068 B2
(45) Date of Patent: Apr. 13, 2004

(54) PROBING DEVICE WITH MICROWAVE TRANSMISSION

(75) Inventor: Lennart Jönsson, Göteborg (SE)

(73) Assignee: Ingenjorsfirman Geotech AB, Askin (SE)

( * ) Notice: Subject to any disclaimer, the term of this patent is extended or adjusted under 35 U.S.C. 154(b) by 0 days.

(21) Appl. No.: 10/157,484

(22) Filed: May 30, 2002

(65) Prior Publication Data

US 2003/0141110 A1 Jul. 31, 2003

(30) Foreign Application Priority Data

Jan. 29, 2002 (EP) ..... 02002126

(51) Int. Cl.[7] ..... E21B 7/26

(52) U.S. Cl. ..... 175/19; 374/122; 374/136; 324/338; 324/76.14; 73/428; 73/866.5

(58) Field of Search ..... 175/19, 23, 44; 374/122, 136, 155; 173/145; 324/338, 332, 76.14; 73/864.43, 866.5, 428

(56) References Cited

U.S. PATENT DOCUMENTS

| | | | | |
|---|---|---|---|---|
| 3,905,010 | A | | 9/1975 | Fitzpatrick |
| 4,251,773 | A | * | 2/1981 | Cailliau et al. |
| 5,177,709 | A | | 1/1993 | Baziw |
| 5,243,290 | A | * | 9/1993 | Safinya et al. |
| 5,377,551 | A | * | 1/1995 | Vacquer |
| 5,406,206 | A | * | 4/1995 | Safinya et al. |
| 5,831,549 | A | | 11/1998 | Gearhart |
| 5,902,939 | A | | 5/1999 | Ballard et al. |

FOREIGN PATENT DOCUMENTS

| | | |
|---|---|---|
| EP | 0102 672 | 4/1986 |
| EP | 1 065 530 A1 | 1/2001 |
| WO | WO 00/55468 | 9/2000 |

* cited by examiner

*Primary Examiner*—Roger Schoeppel
(74) *Attorney, Agent, or Firm*—Harness, Dickey & Pierce, P.L.C.

(57) ABSTRACT

Geological probing device comprising a hollow probing rod to be extended into the geological matter to be probed, and a measuring probe fitted to the probing rod, said measuring probe comprising sensors for obtaining information about the matter.

The measuring probe further comprises a microwave transmitter, arranged to transmit microwaves carrying data from said sensors, said hollow probing rod being adapted to act as a waveguide, guiding the microwaves to an upper orifice of said hollow probing rod.

Compared to previously known techniques, the device according to the invention offers a reliable transmission of data under normal working conditions, and without substantive modifications of the probing rod or other equipment.

24 Claims, 2 Drawing Sheets

PROBING DEVICE WITH MICROWAVE TRANSMISSION

TECHNICAL FIELD

The present invention relates to a geological probing device comprising a hollow probing rod to be extended into the geological matter to be probed, and a measuring probe fitted to the probing rod, the measuring probe comprising at least one sensor for obtaining information (e.g. physical and chemical characteristics) about the matter (e.g. soil or rock).

Such probing devices can be implemented in Cone Penetration Test (CPT) equipment, and are primarily used in geotechnical investigations, but can also be used in geological investigations in general, on and off shore.

TECHNICAL BACKGROUND

A probing device of this kind is shown in U.S. Pat. No. 5,902,939. A drive mechanism is provided to push the probing rod into the soil, for example using hydraulic force. During operation, the probing rod is extended one section at a time, whereby each new section is linked to the sections of the probing rod already pushed down, for example by means of screw threads in the ends of each section. Preferably, the process of linking sections together can be performed without interrupting operation of the drive mechanism.

A measuring probe is fitted to the probing rod, preferably close to the tip of the rod, and can be adapted to measure friction, probe inclination, water pressure, etc, using one or several sensors. At the surface, processing and recording equipment is arranged to receive data from the probe.

When using probing devices of this kind, the data from the probe can be transmitted to the equipment at the surface using different techniques.

In the probing device mentioned above, the data is transmitted by means of a electrical or optical cable, running through the hollow probing rod. Such a cable complicates the process of linking rod sections during operation.

According to another known technique, the data is transmitted using acoustic signals, propagating through the material of the probing rod. A drawback with this solution is the transmitted signal's sensitivity to noise in the ground, caused by e.g. heavy equipment on the surface and the friction against the probing device itself. Also, the qualities of the soil has an important impact on the transmitted signal. Too much noise makes it difficult to process and analyze the acquired data.

A third solution is presented in EP 1065530, describing optical transmission of data. In this case, each section of the probing rod is provided with one or several optical guides located inside the hollow probing rod section. The optical guide section is in the form of a glass or plastic rod, or one or several optical fibers. When the rod sections are linked together, a continuous optical guide is formed, allowing transmission of optical signals from the probe to a receiver located at end of the probing rod, normally above the surface.

Although this solution eliminates the need for providing a cable into the rod, it complicates the linking of rod sections, as care has to be taken not to disrupt the optical guide. Also, the probing rod sections become more expensive, and also more sensitive to environment and treatment. Additionally, the process of receiving the optical signals is very delicate, and can easily be interrupted. Notably, the optical link will be interrupted each time a new rod section is linked to the probing rod. EP 1065530 attempts to solve such problems, including memory units, optical mirrors, camera based sensors, etc, resulting in a complex and costly probing device. It is considered that such an optical system is badly suited for the conditions present during soil probing.

SUMMARY DISCLOSURE OF THE INVENTION

Therefore, it is an object of the present invention to provide an improved geological probing device, alleviating the above mentioned problems.

More specifically, it is an object of the invention to provide an improved data transmission in a geological probing device.

These and other objects are accomplished by a geological probing device of the kind mentioned by way of introduction, wherein the measuring probe further comprises a microwave transmitter, arranged to transmit microwaves carrying data from said sensor, and wherein the hollow probing rod is adapted to act as a waveguide, guiding the microwaves to an upper orifice of said hollow probing rod.

According to the invention, the interior of the probing rod is thus employed as a waveguide, through which the microwaves can propagate from the probe to the upper orifice, located above or close to the surface. Conventional probing rods, typically made of steel, offer satisfactory wave guiding characteristics in the micro frequency range, and no particular preparation of the probing rod therefore needs to be performed.

It should be noted that the term "hollow" refers to the rod itself. In other words, the hollow space may well be filed with some material other than air, such as a suitable dielectric material, e.g. Teflon.

Compared to previously known techniques, the device according to the invention offers a reliable transmission of data under normal working conditions, and without substantial modifications of the probing rod. In fact, a conventional probing device can be adapted to the invention, by being provided with a microwave transmitter and a suitable interface(s).

Compared to acoustic transmission, the inventive device is less vulnerable to unpredictable sources of disturbance, such as characteristics of the geological matter and surroundings. Instead, the transmission of microwaves depends on factors inherently present in the device itself, such as the inner surface of the probing rod.

Compared to optical transmission, a micro wave based system is more robust, and signals will not be interrupted as easily. Although microwaves, like optical waves, cannot penetrate objects in their path, they are more easily reflected in e.g. the frame of a penetrometer, and can therefore often reach a receiver despite objects being placed in between.

The probing rod can be formed by a plurality of rod sections, arranged to be linked together one by one during extension thereof into the geological matter. This offers flexibility when extending the probing rod deep into the ground or sea bed. As mentioned, the microwaves will be spread and reflected when they leave the upper orifice of the rod, and a linking of an additional rod section will therefore only cause a minor disruption in signal reception.

Preferably, the device comprises a receiver at a location outside said upper orifice, adapted to receive the microwaves propagated through the probing rod. The receiver can comprise several receiving units, with different polarization, in order to further minimize disruptions of the signal caused e.g. when linking a new rod section, and to improve reception in general. The microwaves can have a frequency in the range 2–300 GHz, and preferably in the range 5–30 GHz. The most suitable frequency primarily depends on the characteristics of the probing rod (section shape, diameter) acting as a waveguide. In principle, a lower frequency wave requires a larger diameter waveguide. Further, some frequencies (e.g. the 5.6 GHz-band, the 24 GHz-band) are more convenient, as they do not require the end user to have permission from the national telecommunication authority, as long as the equipment is certified.

The geological matter can be soil, such as sand, clay, silt, and the probing rod can then be pushed into the soil using e.g. a hydraulic drive mechanism.

Alternatively, the geological matter can be rock, in which case the probing rod can be equipped with a suitable drilling point and be drilled into the rock.

The probing device can be used in all types of geological investigation, including geotechnical investigations on land, and off-shore investigations.

BRIEF DESCRIPTION OF THE DRAWINGS

These and other aspects of the invention will be apparent from the preferred embodiments more clearly described with reference to the appended drawings.

DETAILED DESCRIPTION OF PREFERRED EMBODIMENTS

Figure 1:
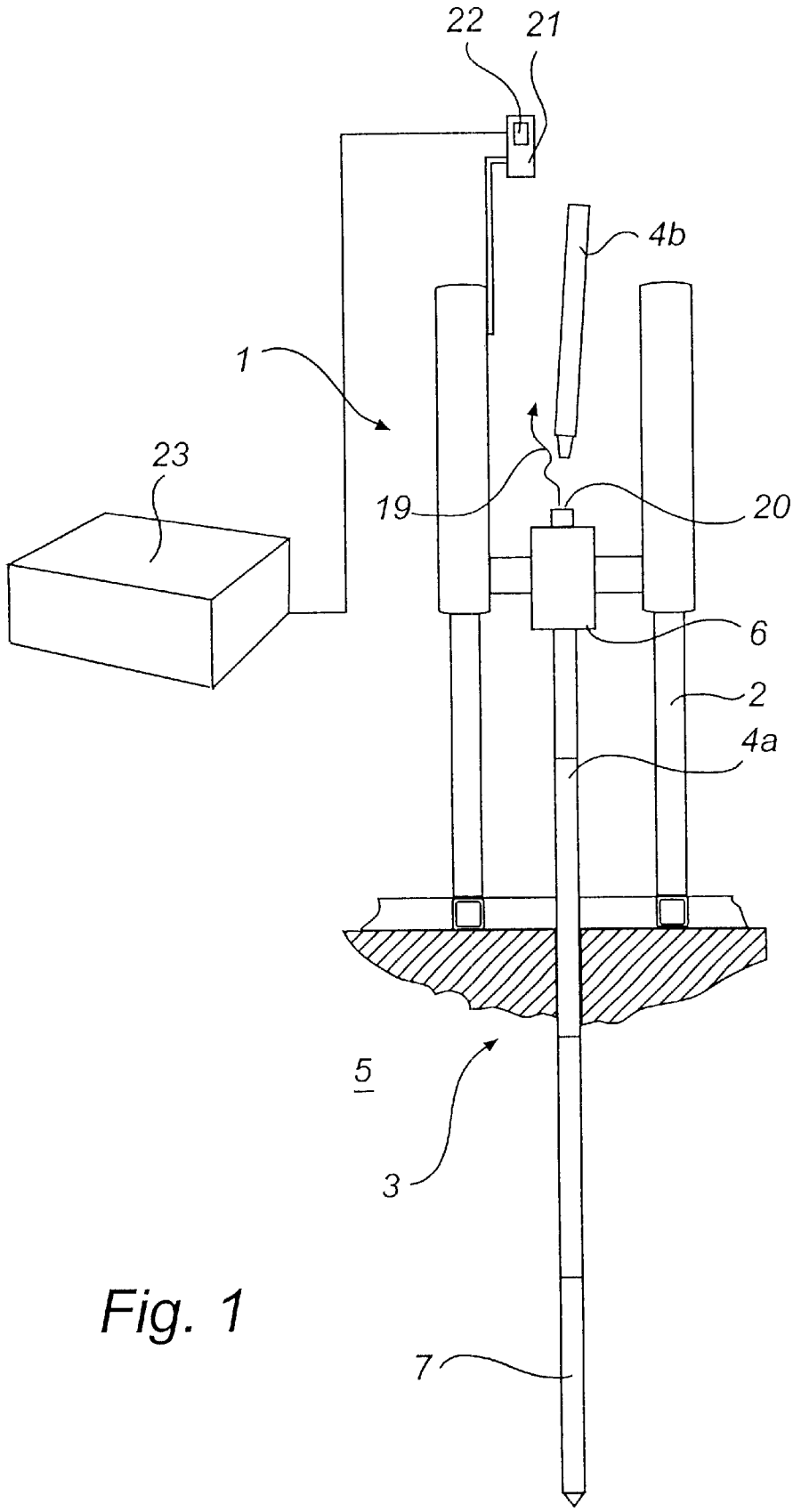
FIG. 1 shows a penetrometer according to an embodiment of the invention.

The following description of a preferred embodiment is related to a penetrometer 1 uses hydraulic cylinders 2 to push a probing rod 3 consisting of several rod sections 4 into the ground 5. The rod is typically made of steel, with standard diameter of for example 36 mm or 44 mm. The force from the cylinders 2 is transferred to the probing rod 3 by means of a clamp 6 (e.g. hydraulic or mechanical), arranged around one of the rod sections 4*a* protruding above the surface of the ground. As this section is pushed further into the ground, a consecutive section 4*b* is linked to the probing rod 3, and the clamp 6 is released and then moved, in order to shift its point of application to this new rod section 4*b*. This process forces the probing rod 2 further and further down into the ground 5.

Figure 2:
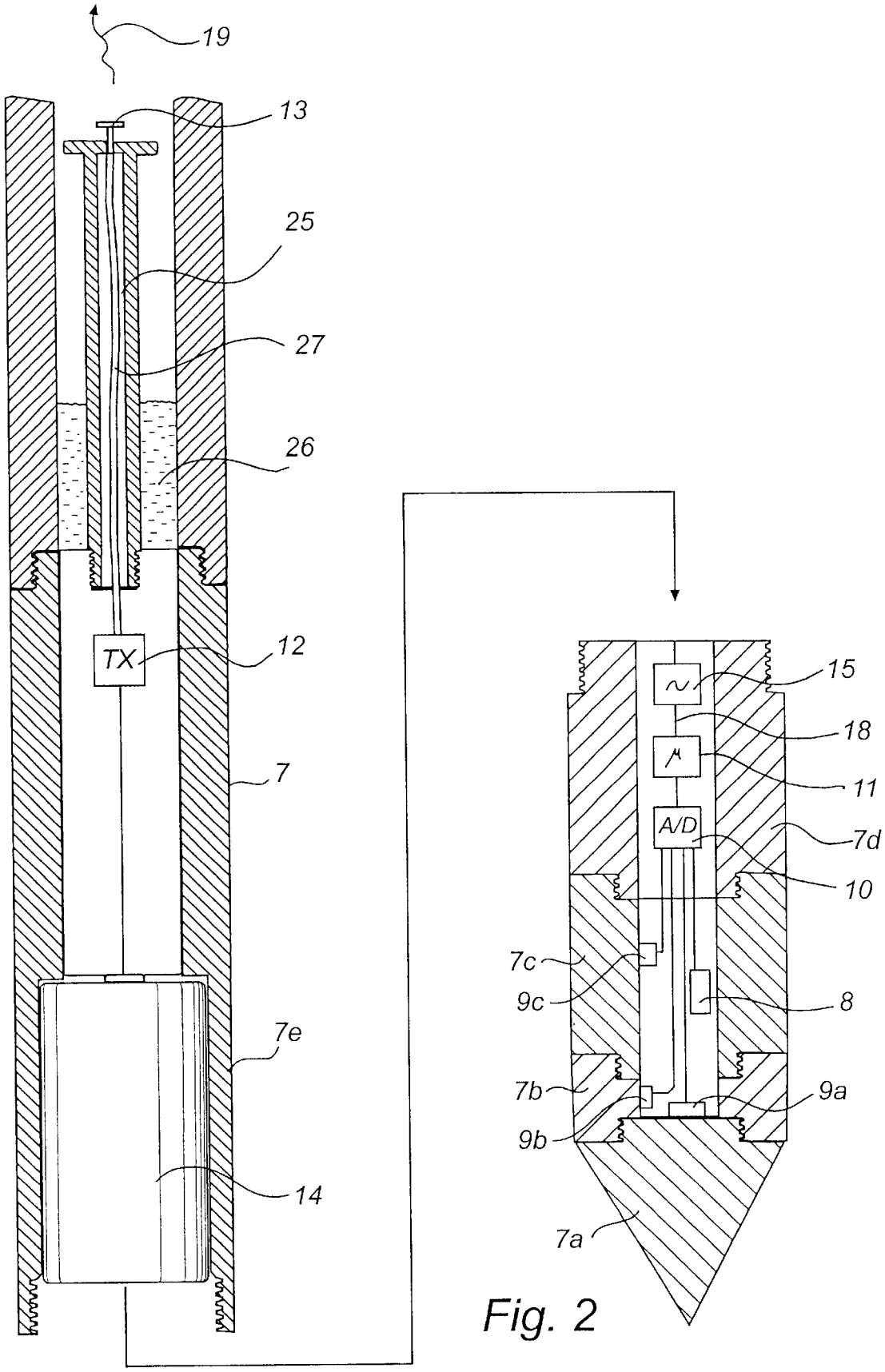
FIG. 2 shows the probe of the penetrometer in FIG. 1 in more detail.

The first, leading section of the probing rod, shown in more detail in FIG. 2, is referred to as the probe 7, and comprises five parts, 7*a–e*. The first three parts are different sensors, namely a conical pressure sensor 7*a*, a water filter for measuring 7*b*, and a friction sleeve. Additionally, the probe 7 can be provided with an inclinometer 8, arranged inside the friction sleeve. Transducers for generating electrical signals are schematically illustrated by 9*a–c* in FIG. 2.

The next part 7*d* of the probe 7 is provided with an A/D-converter 10, and a micro processor 11, processing the data from the transducers 9. The top part 7*e* of the probe 7 comprises a microwave transmitter 12, with an dipole antenna 13 and a power source 14, such as a replaceable or rechargeable battery pack.

The measured data from the sensors, is digitized and multiplexed into one digital signal 18, and then supplied to the transmitter 12. In the illustrated example, the signal 18 is modulated by a carrier wave 15, and carried through the battery pack 14, avoiding the need for signal terminals between the probe parts 7*d* and 7*e*. The transmitter 12 encodes the signal into a microwave carried signal 19 which is then transmitted by the dipole 13 into the interior of the probing rod 3.

Returning to FIG. 1, the probing rod 3 acts as a microwave guide, and guides the microwave signal 19 to the orifice 20 of the probing rod, located above ground. In the illustrated example, a microwave receiver 21 is arranged above this orifice 20, and adapted to receive the microwave signal 19 propagating through the probing rod 3. The receiver can be fixedly mounted on the frame of the penetrometer 1, or on the hydraulic cylinders 2. However, the receiver should be mounted so that it is located above the orifice 20 even during the linking of a new rod section to the probing rod. The receiver 21 can comprise circuitry 22 for decoding the microwave signal 19 and extracting the measuring data signal 18.

The receiver 21 can in turn supply the signal 18 to be connected to equipment 23 for processing and logging the measured data. Such equipment 23 can be a data acquisitioning device of previously known type, and the receiver 21 can then be provided with circuitry (not shown) for supplying the equipment 23 with a signal it can interpret.

In an alternative embodiment, the receiver 21 can be arranged in contact with the orifice 20, in order to improve the quality of the received signal. The receiver can be fitted onto the rod section 4 currently being pushed into the ground, and then moved when the next rod section is linked. Alternatively, the penetrometer 1 is arranged to push the probing rod by making contact with the upper end thereof, and the receiver can then be arranged in this part of the penetrometer.

To ensure that the probing rod is not filled with water, water tight or at least water resistant seals can be provided between the rod sections 4. In some cases it can suffice to apply grease on the screw threads of the rod sections 4, in other cases alternative linking means may have to be considered. In order to manage smaller amounts of water penetrating into the probing rod 3, the dipole 13 can be arranged on a support 25, ensuring that the dipole is located above the surface of any such water 26. The dipole is then connected to the transmitter 12 by e.g. a coaxial cable 27.

In a system tested by the applicant, the acoustic transmitter of a CPT probe of conventional type was replaced by a microwave transmitter according to the invention. Also, the microphone of the acoustic system was replaced by a microwave receiver. It is in fact one of the advantages of the present invention that it can be implemented in an existing system by a person skilled in the art.

The probe was pushed down into the ground using a 36 mm steel probing rod. The inner diameter of the rod was 16 mm, resulting in a cut-off frequency of around 11 GHz (the cut-off frequency of circular waveguide is inversely proportional to the radius). For this reason, a working frequency of 12.5 GHz was chosen. Depending on the dimensions and shape of the probing rod different frequencies in the microwave range can be preferred, and it is envisaged that different frequencies may be used in the future. Also, it may be convenient to choose a frequency that does not require the end user to acquire a permission from the authorities. Presently, examples of such frequencies are in the bands around 5.6 GHz, 24 GHz, 47 GHz and 76 GHz.

It should also be noted that it is not always advantageous to use the first node of the wave for transmission. As the damping may vary for different nodes, there is no linear relationship between damping and frequency.

The power of the transmitter was less than 10 mW, and it was powered by six standard batteries, normally used for driving an acoustic transmitter.

The working depth, i.e. the depth at which the system will provide satisfactory signal quality, is dependent primarily on the damping of the steel rod waveguide and the dynamics of the receiver. Due to corrosion and irregularities of the inner surface of the rod 3, leading to impaired surface conductivity, damping in the tested frequency range is relatively high, in the order of several dB/m.

However, it is believed that the damping can be reduced using very simple measures, such as coating of the inner surface of the probing rod, for example with silver. Another important factor are the junctions between rod sections. They form a discontinuity in the waveguide, and may cause resonance and act as a filter, seriously impairing the performance of the waveguide. By redesigning the linking of the rod section, reduced damping may be obtained. Finally, it is possible that a significantly increased frequency (in the order of several hundred GHz) can improve the performance of the waveguide, as the effect of surface conductivity looses relative importance.

The bit rate capacity of the tested data transmission around 9600 baud, due to the conventional circuitry used in the probe and data acquisitioning device. However, it is estimated that transmission rates of at least 10 Mbit/s can be obtained, offering a significant improvement in data transmission capacity.

The invention has been described with reference to CPT probing. However, it should be noted that the invention is not limited to CPT probes, but on the contrary, any probe and any type of sensors can be used. Also, the invention is also applicable in equipment for drilling, e.g. in rock or seabeds. The diameter of the probing rod is then normally somewhat larger, e.g. 56 mm, 76 mm, and provided with a drilling head. Some kind of drilling machinery is used to rotate the drilling head.

What is claimed is:

1. Geological probing device comprising:

a hollow probing rod to be extended into the geological matter to be probed, and a measuring probe fitted to the probing rod, said measuring probe including:

at least one sensor for obtaining information about the matter, and a microwave transmitter, arranged to transmit microwaves carrying data from said sensors, said hollow probing rod being adapted to act as a waveguide, guiding the microwaves to an upper orifice of said hollow probing rod.

2. Device according to claim 1, wherein the probing rod is formed by a plurality of hollow rod sections, arranged to be linked together one by one during extension thereof into the geological matter.

3. Device according to claim 1, further comprising a receiver at a location outside said upper orifice.

4. Device according to claim 1, wherein said microwaves have a frequency in the range 2–300 GHz.

5. Device according to claim 1, wherein said geological matter is soil, and the probing rod is pushed into the soil.

6. Device according to claim 1, wherein said geological matter is rock, and the probing rod is drilled into the rock.

7. Device according to claim 1, wherein said microwaves have a frequency in the range of 5–30 GHz.

8. Device according to claim 1, wherein the hollow probing rod includes a plurality of hollow rod sections, and wherein at least one hollow rod section is between the upper orifice and the measuring probe.

9. A pentrometer, comprising the geological probing device of claim 1.

10. The pentrometer of claim 9, further comprising a receiver at a location outside said upper orifice.

11. The pentrometer of claim 10, wherein the receiver includes a plurality of units of relatively different polarizations.

12. The pentrometer of claim 9, further comprising a hydraulic device for moving the hollow probing rod into the geological matter.

13. A geological probing device, comprising:

a probing rod, extendable into geological matter to be probed; and a probe, the probe including, means for obtaining information about the geological matter, and means for transmitting microwaves carrying the obtained information, wherein a hollow portion of the probing rod is adapted to act as a waveguide to guide the microwaves to an upper orifice of the probing rod.

14. The geological probing device of claim 13, wherein means for receiving the transmitted microwaves is located outside the upper orifice.

15. The geological probing device of claim 13, wherein the probing rod is formed by a plurality of hollow rod sections, arranged to be linked together one by one during extension thereof into the geological matter.

16. The geological probing device of claim 13, wherein said microwaves have a frequency in the range 2–300 GHz.

17. The geological probing device of claim 13, wherein said geological matter is soil, and the probing rod is pushed into the soil.

18. The geological probing device of claim 13, wherein said geological matter is rock, and the probing rod is drilled into the rock.

19. The geological probing device of claim 13, wherein said microwaves have a frequency in the range of 5–30 GHz.

20. The geological probing device of claim 13, wherein the probing rod includes a plurality of hollow rod sections, and wherein at least one hollow rod section is between the upper orifice and the probe.

21. A pentrometer comprising the geological probing device of claim 13.

22. The pentrometer of claim 21, further comprising a receiver at location outside said upper orifice.

23. The pentrometer of claim 22, wherein the receiver includes a plurality of units of relatively different polarizations.

24. The pentrometer of claim 21, further comprising a hydraulic device for moving the probing rod into the geological matter.

* * * * *